US005245924A

United States Patent [19]

Kiamco et al.

[11] Patent Number: 5,245,924

[45] Date of Patent: Sep. 21, 1993

[54] LOCKING AND ADJUSTING DEVICE FOR A PRINTING PRESS

[75] Inventors: Robert C. Kiamco, Wood Dale; C. K. Shah, Niles; Louis S. Depa, Downers Grove, all of Ill.

[73] Assignee: Rockwell International Corporation, Seal Beach, Calif.

[21] Appl. No.: 947,319

[22] Filed: Sep. 18, 1992

[51] Int. Cl.[5] ..... B41F 27/12

[52] U.S. Cl. ..... 101/415.1; 101/378

[58] Field of Search ..... 101/378, 415.1, 408, 101/409, 410, 411, 412

[56] References Cited

U.S. PATENT DOCUMENTS

| | | | |
|---|---|---|---|
| 1,858,305 | 5/1932 | Meisel et al. | 101/415.1 |
| 3,739,675 | 6/1973 | Duckett | 83/659 |
| 3,757,690 | 9/1973 | Skiera et al. | 101/415.1 |
| 3,772,991 | 11/1973 | Taguchi et al. | 101/415.1 |
| 3,913,480 | 10/1975 | Dauner et al. | 101/415.1 |
| 4,183,299 | 1/1980 | Cappel | 101/415.1 |
| 5,156,091 | 10/1992 | Bätz | 101/415.1 |

FOREIGN PATENT DOCUMENTS

| | | | |
|---|---|---|---|
| 2437758 | 2/1976 | Fed. Rep. of Germany | 101/415.1 |
| 2092956 | 8/1982 | United Kingdom | 101/415.1 |

*Primary Examiner*—Edgar S. Burr
*Assistant Examiner*—Ren Yan
*Attorney, Agent, or Firm*—C. B. Patti; V. L. Sewell; H. F. Hamann

[57] ABSTRACT

A locking device (12) for a printing press (10) having a cylinder (40) having an outer surface (44) and an elongated slot (46) adjacent the outer surface (44), with the slot (46) having a lower surface (48) and a pair of opposed first and second side surfaces (50 and 52) extending between the lower surface (48) of the slot (46) and the outer surface (44) of the cylinder (40), a slide block (54) having an outer surface (56) and being slidably received in the slot (46), with the slide block (54) being movable between a first inner position with the outer surface (56) of the slide block (54) being flush with the outer surface (44) of the cylinder (40), and a second outer position with the slide block (54) projecting above the outer surface (44) of the cylinder (40), a retaining member (20) rotatably mounted in the slide block (54) and having an elongated groove (22) and a blanket (68) having one end (70) received against the first surface (50) of the slot (46) and a second end (72) received in the groove (22) of the retaining member (20) when the slide block (54) is located in the second outer position with the blanket (68) extending peripherally around the outer surface (44) of the cylinder (40), and a device (16 and 18) for rotating the retaining member (20) to tighten and retain the blanket (68) on the blanket cylinder (40) and a device (80 and 92) for releasably locking the slide block (54) at the inner position.

7 Claims, 4 Drawing Sheets

LOCKING AND ADJUSTING DEVICE FOR A PRINTING PRESS

BACKGROUND OF THE INVENTION

The present invention relates to locking devices for a printing press.

In the past, blankets, such as for offset lithography, have been used on blanket cylinders for printing a document, such as a newspaper. Typically, the blankets have been mounted on a blanket cylinder peripherally around the cylinder, and the cylinder has been provided with a slot to receive leading and trailing edges of the blankets. It has been found that some difficulty may be encountered in securing the blanket edges in the slots. Prior devices which have been used for this purpose have been unduly complex and complicated in their use, and may require the use of tools for securement in an environment where the tools may be accidentally dropped into the press, thus causing damage to the press. In addition, the prior blankets when secured to the blanket cylinder have resulted in a relatively large non-printing gap, such as 0.25 to 0.375" which limits the amount of press speed without producing print streaks or slurs. In addition, such blankets may cause considerable noise due to the relatively large gap of the blanket on the blanket cylinders. Further, it has been somewhat difficult to secure the blankets to the blanket cylinder.

SUMMARY OF INVENTION

A principal feature of the present invention is the provision of an improved locking device for a printing press.

The locking device of the present invention comprises, a cylinder having an outer surface and an elongated slot adjacent the outer surface, with the slot having a lower surface and a pair of opposed first and second side surfaces extending between the lower surface of the slot and the outer surface of the cylinder, a slide block having an outer surface and being slidably received in the slot, with the slide block being movable between a first inner position with the outer surface of the slide block being flush with the outer surface of the cylinder, and a second outer position with the slide block projecting above the outer surface of the cylinder, and a blanket having one end received against the first surface of the slot.

A feature of the invention is the provision of a retaining member rotatably mounted in the slide block and having an elongated groove.

Another feature of the invention is that the blanket has a second end received in the groove of the retaining member.

Yet another feature of the invention is that the second end of the blanket may be easily placed in the groove of the retaining member when the slide block is located in the second outer position, with the blanket extending peripherally around the outer surface of the cylinder.

Still another feature of the invention is the provision of means for rotating the retaining member in order to tighten and retain the blanket on the blanket cylinder responsive to movement of the slide block to the inner position.

Yet another feature of the invention is the provision of means for releasably locking the slide block at the inner position.

Yet another feature of the invention is that the locking device permits securement of the blanket to the blanket cylinder in a rapid and simplified manner.

A further feature of the invention is that the locking device is of simplified construction and reduced cost.

Still another feature of the invention is that the locked blanket provides a relatively narrow non-printing gap, such as 0.090".

A further feature of the invention is that the relatively narrow gap of the blanket cylinder permits increased press speed without producing printing streaks or slurs.

Yet another feature of the invention is that the device permits a wider web width press.

Still another feature of the invention is that the device results in a quieter press unit due to less gap disturbance of the blanket.

Further features will become more fully apparent in the following description of the embodiments of this invention, and from the appended claims.

DESCRIPTION OF THE PREFERRED EMBODIMENT

Figure 1:
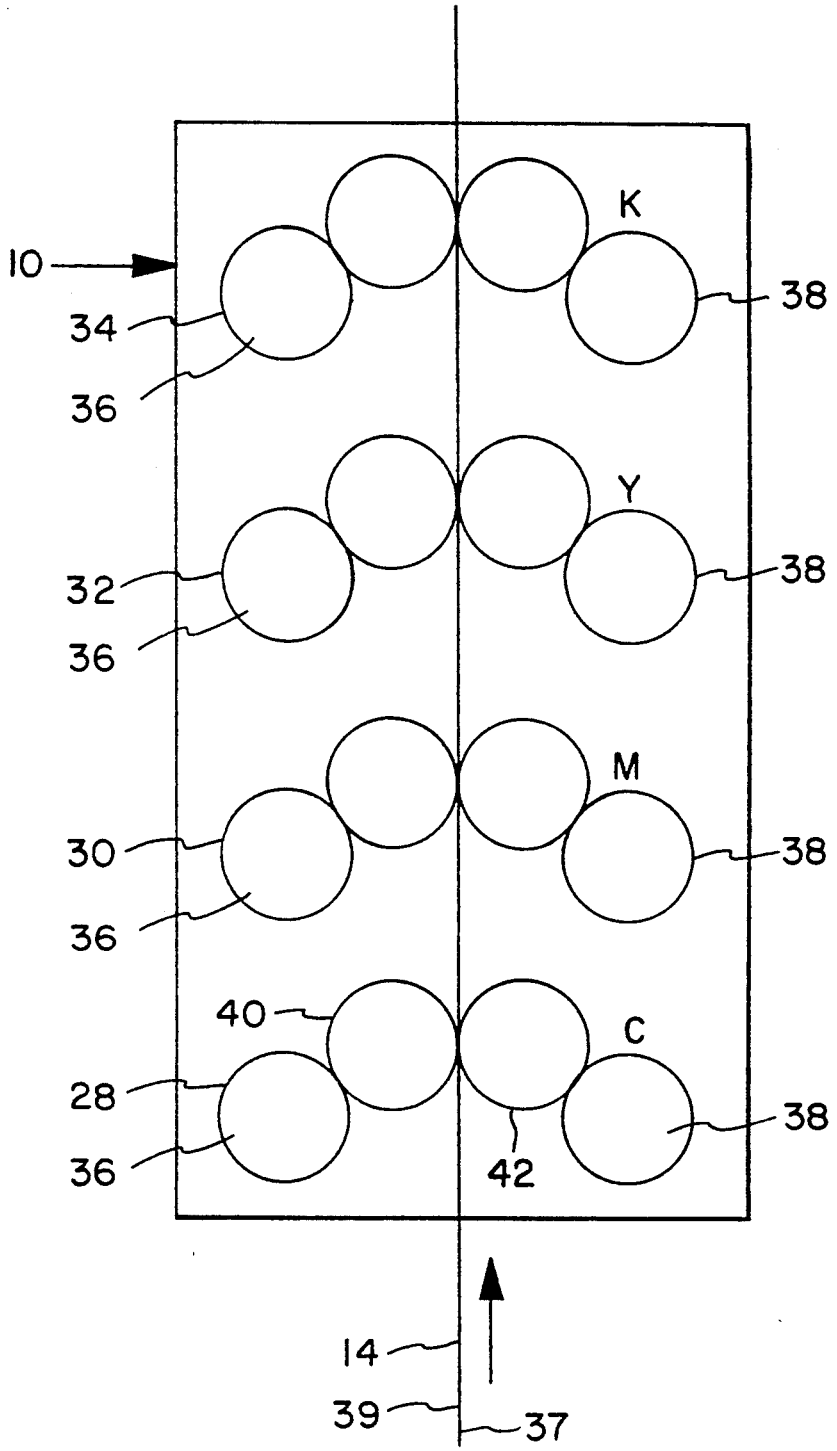
FIG. 1 is a diagrammatic view of a printing press.

Referring now to FIG. 1, there is shown a printing press generally designated 10 for printing an image on a paper web 14. The press 10 has a plurality of printing units 28, 30, 32, and 34 for printing different colors of ink on the web 14. As shown, the printing unit 28 may print an ink having a color Cyan C, the printing unit 30 may print an ink having a color Magenta M, the printing unit 32 may print an ink having a color Yellow Y, and the printing unit 34 may print an ink having a color Black K, in a four-color press 10.

The printing units 28, 30, 32, and 34 each have a plurality of plate cylinders or rolls 36 associated with a blanket cylinder or roll 40. During printing by the press 10, an image of the ink is transferred from the plate roll 36 to the associated blanket roll 40 to print the image on one surface 39 of the web 14. In addition, the press 10 may have a plurality of printing units having a plurality of plate cylinders or rolls 38 associated with a plurality of blanket rolls or cylinders 42 on an opposed side 37 of the web 14 in order to transfer the ink image from the print plate roll 38 to the blanket roll 42 for printing an image on the other surface 37 of the web 14.

Figure 2:
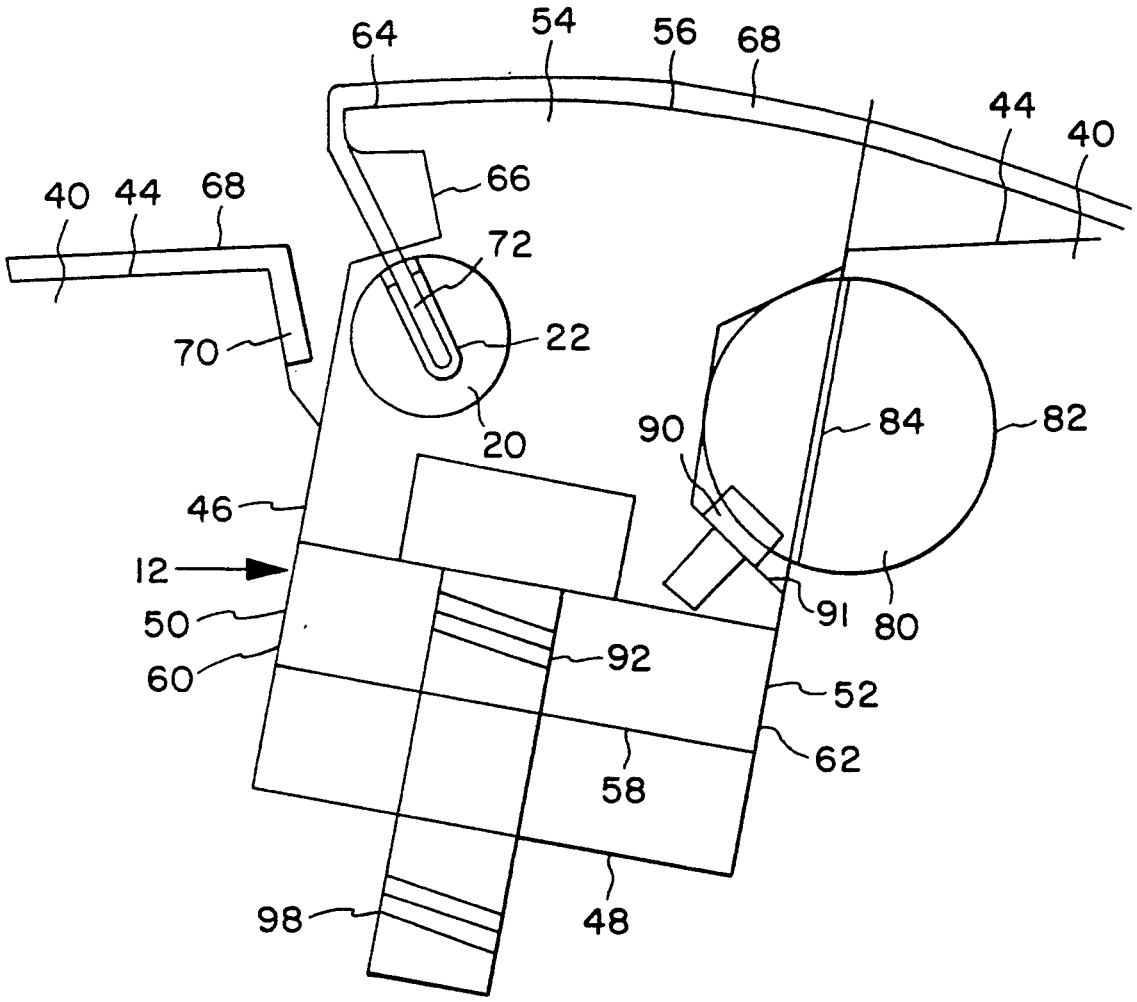
FIG. 2 is a fragmentary sectional view showing a locking and adjusting device of the present invention in a configuration to receive one end of a blanket.
Figure 3:
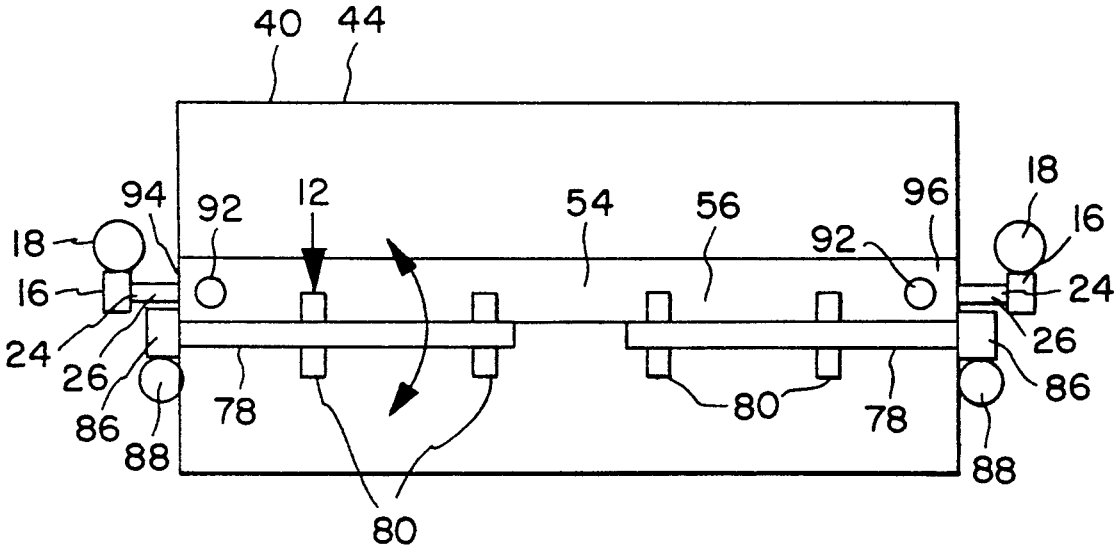
FIG. 3 is a plan view of the locking device of the present invention.

As shown in FIGS. 2 and 3, the press 10 has a locking device generally designated 12 for securing a blanket 68 on the blanket cylinder 40. Of course, the other blanket cylinder 42 may also have an associated blanket secured to the blanket cylinder 42 in a manner as described in connection with the blanket cylinder 40.

The blanket cylinder 40 has an outer surface 44, and an elongated slot 46 adjacent the outer surface 44 of the blanket cylinder 40. The slot 46 has a lower surface 48 and a pair of opposed first and second side surfaces 50 and 52 extending between the lower surface 48 of the slot 46 and the outer surface 44 of the blanket cylinder 40.

As shown, the locking device 12 has a slide block 54 having an outer surface 56 and being slidably received in the slot 46, such that the slide block 54 is movable between a first inner position with the outer surface 56 of the slide block 54 being flush with the outer surface 44 of the cylinder 40, and a second outer position with the slide block 54 projecting above the outer surface 44 of the blanket cylinder 40. The slide block 54 also has a lower surface 58, and a pair of first and second side surfaces 60 and 62 extending from the lower surface 58 of the slide block 54.

The locking device 12 has a retaining member 20 rotatably mounted in the slide block 54, and having an elongated groove 22. The blanket 68 has one end 70 received against the first surface 50 of the slot 46, and a second end 72 received in the groove 22 of the retaining member 20 in a configuration with the groove 22 being directed outwardly from the slide block 54. The second end 72 of the blanket 68 is inserted into the groove 22 and the first end 70 of the blanket 68 is positioned against the first side surface 50 of the slot 46 when the slide block 54 is located in the second outer position with the blanket 68 extending peripherally around the outer surface 44 of the cylinder 40.

As shown in FIG. 3, the retaining member 20 includes an elongated shaft 24 having opposed ends 26 projecting beyond the ends of the cylinder 40. In a preferred form, a gear 16 is secured to the opposed ends of the rotatable shaft 24, and the locking device 12 has a worm gear 18 engaged with the gear 16 of the shaft 24, such that rotation of the worm gear 18 by a suitable device, such as a wrench, causes rotation of the shaft 24 and retaining member 20. In this manner, the blanket 68 may be tightened about the blanket cylinder 40 through rotation of the retaining member 20 to a lower position in the slot 46 in order to adjust and tighten the blanket 68 on the cylinder 40 in a simplified manner. After the blanket 68 has its ends secured in the locking device 12, the slide block 54 is moved to its inner position in the slot 46 with the blanket 68 in a configuration locked against the first surface 50 of the slot 46 and in the groove 22 of the retaining member 20.

As shown in FIG. 2, the locking device 12 has a plurality of cam members 80 mounted with the cam members 80 being received in a generally circular or oval cut-out or recess 82. The cam members 80 have a locking surface 84 facing towards the second side surface 62 of the slide block 54, with the locking surface 84 being spaced from the slide block 54. As shown in FIG. 3, the locking device 12 has a pair of cam shafts 78 with associated cam members 80 on opposed sides of the cylinder 40. The locking device 12 has a pair of gears 86 secured to opposed ends of the two shafts 78, which are engaged with suitable worm gears 88 on each end of the cylinder 40, such that rotation of the worm gears 88 cause rotation of the shaft 78 and associated cam members 80 such that the locking surface 84 of the cam members 80 engages against buttons 90 or ledge 91 of the slide block 54 in order to releasably retain the slide block 54 at its first inner position where the blanket 68 is securely retained on the blanket cylinder 40.

Figure 4:
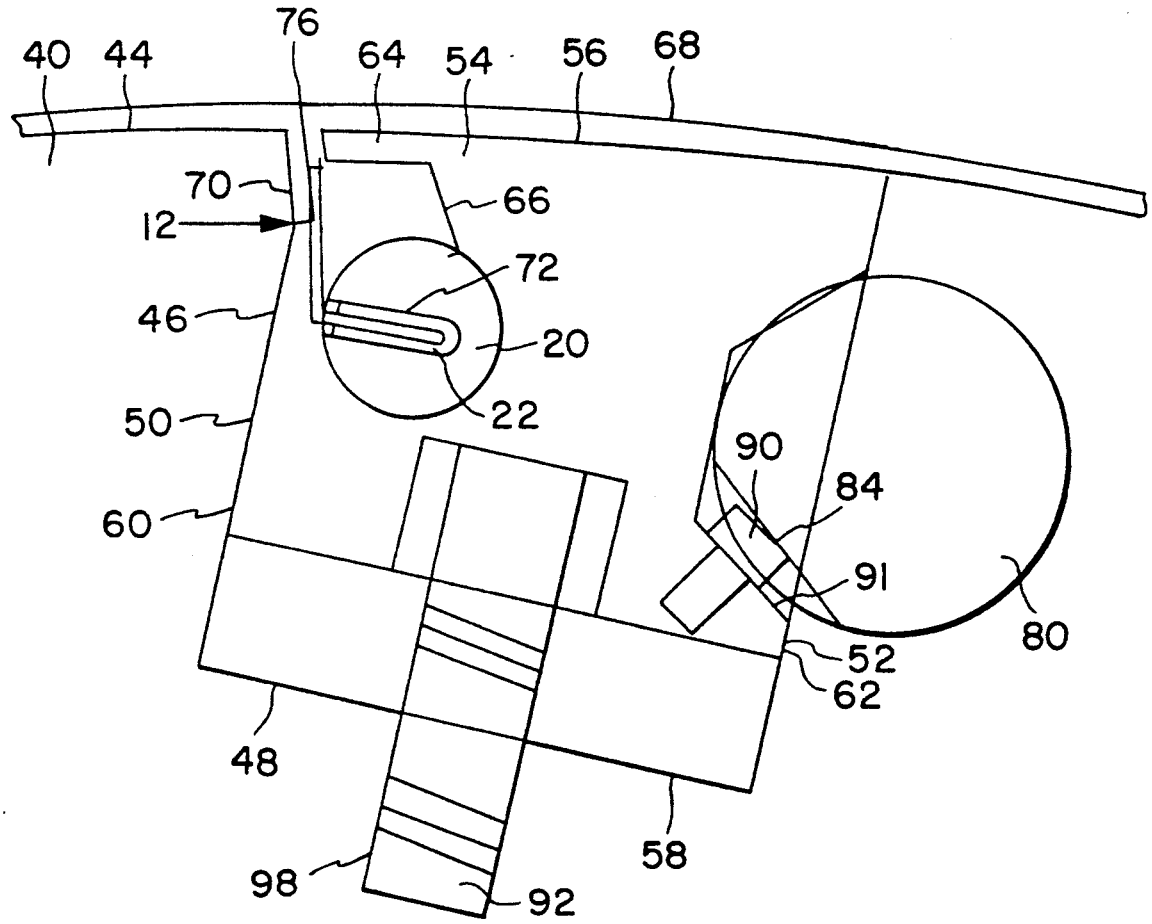
FIG. 4 is a fragmentary sectional view showing the blanket secured on a blanket cylinder by the locking and adjusting device of the present invention.

In addition, as shown in FIGS. 2 and 4, the locking device 12 may have a pair of threaded bolts 92 received on opposed ends 94 and 96 of the slide block 54 and extending through the slide block 54, such that ends of the bolts TM 92 may be received in threaded bolts 98 of the cylinder 40. In this manner, the bolts 92 may be tightened with the slide block 54 at its inner position in order to releasably lock the slide block 54 at the inner position.

Thus, in accordance with the present invention, the blanket 68 may be tightened by the retaining member 20 of the slide block 54 at an outer projecting position of the slide block 54, and the slide block 54 may be moved to an inner position in order to secure the blanket 68 to the cylinder 40 with the blanket 68 extending around the cylinder 40. The cam members 80 and bolts 92 are then utilized to releasably secure the slide block 54 at its inner position in order to releasably lock the blanket 68 on the cylinder 40.

The press 10 has an improved locking and adjusting device 12 in order to releasably lock the blanket 68 on the blanket cylinder 40 in a simplified and rapid manner. The slide block 54 may be moved to its outer position in order to release the blanket 68 when the printing run by the press 10 has been completed. The locking device 12 simplifies the locking procedure and provides a relatively small non-print gap in order to enhance the speed of the press 10 without printing streaks or slurs. In addition, the locking and adjusting device 12 provides a quieter press due to less gap disturbance, and permits wider web widths on the press 10.

The foregoing detailed description has been given for clearness of understanding only, and no unnecessary limitations should be understood therefrom, as modifications will be obvious to those skilled in the art.

What is claimed is:

1. A locking device for a printing press, comprising:

a cylinder having an outer surface and an elongated slot adjacent the outer surface, with the slot having a lower surface and a pair of opposed first and second side surfaces extending between the lower surface of the slot and the outer surface of the cylinder;

a slide block having an outer surface and being received in the slot, means mounting the slide block for linear movement between a first inner position with the outer surface of the slide block being flush with the outer surface of the cylinder, and a second outer position with the slide block projecting above the outer surface of the cylinder;

a retaining member rotatably mounted in the slide block and having an elongated groove;

a blanket having one end received against the first surface of the slot and a second end received in the groove of the retaining member when the slide block is located in the second outer position with the blanket extending peripherally around the outer surface of the cylinder;

means for rotating the retaining member to tighten and retain the blanket on the blanket cylinder; and means for releasably locking the slide block at the inner position.

2. The device of claim 1 wherein the locking means comprises a threaded bolt received in a threaded bore adjacent the lower surface of the slot and extending through at least a portion of the slide block.

3. The device of claim 2 wherein the bolt is located adjacent an end of the slide block.

4. The device of claim 1 wherein the slide block having a pair of opposed first and second side surfaces, the locking means comprises a rotatable cam located adjacent the second side surface of the slide block and the second side surface of the slot.

5. The device of claim 4 wherein the slide block an inner and an outer ends and has has a ledge intermediate the inner and outer ends of the slide block and facing the second surface of the slot, and in which the cam member has a locking surface which is movable against the ledge of the slide block to releasably lock the slide block at the inner position.

6. The device of claim 5 wherein the locking surface of the cam is movable to a second position drawn away from the ledge to permit movement of the slide block to the second outer position.

7. The device of claim 1 wherein the cylinder comprises a blanket cylinder.

* * * * *